US005523673A

United States Patent [19]

Ratliff et al.

[11] Patent Number: 5,523,673

[45] Date of Patent: Jun. 4, 1996

[54] ELECTRICALLY CONTROLLABLE INDUCTOR

[75] Inventors: David Ratliff, Wixom, Mich.; Peter H. Burgher, Captiva, Fla.; John Boomer, Howell, Mich.

[73] Assignee: Marelco Power Systems, Inc., Howell, Mich.

[21] Appl. No.: 207,014

[22] Filed: Mar. 4, 1994

[51] Int. Cl.[6] ..... G05F 1/70; H01F 27/28

[52] U.S. Cl. ..... 323/206; 336/160

[58] Field of Search ..... 323/206, 249, 323/250, 255, 301, 302, 329, 330, 331; 336/155, 160, 165, 182, 183, 184

[56] References Cited

U.S. PATENT DOCUMENTS

| | | | |
|---|---|---|---|
| 4,393,157 | 7/1983 | Roberge et al. | 323/355 |
| 4,445,082 | 4/1984 | Roberge et al. | 323/206 |
| 4,450,588 | 5/1984 | Rohrich et al. | 455/192 |
| 4,529,956 | 7/1985 | Atherton | 336/83 |
| 4,562,384 | 12/1985 | Owen | 315/276 |
| 4,620,144 | 10/1986 | Bolduc | 323/331 |
| 4,630,013 | 12/1986 | Takada | 334/12 |
| 4,649,337 | 3/1987 | Stucker | 336/136 |
| 4,725,805 | 2/1988 | Takada | 336/83 |
| 4,766,365 | 8/1988 | Bolduc et al. | 323/334 |
| 4,855,890 | 8/1989 | Kammiller | 363/44 |
| 4,980,811 | 12/1990 | Suzuji et al. | 363/21 |
| 5,187,428 | 2/1993 | Hutchison et al. | 336/160 |
| 5,363,035 | 11/1994 | Hutchison et al. | 323/254 |

OTHER PUBLICATIONS

International Search Report dated 19 Jun. 1995.

"ABB Power Systems AB, HVDC Division," Ludvika, Sweden (1994).

*Primary Examiner*—Matthew V. Nguyen

*Attorney, Agent, or Firm*—Brooks & Kushman

[57] ABSTRACT

An apparatus for providing an electrically controllable inductor uses a first and a second magnetic core (20, 24) spaced apart from one another. A DC bias coil (22) is wound on the first magnetic core (20). An inductor coil (26) is wound on both the first magnetic core (20) and the second magnetic core (24). The inductance seen at terminal connections (80, 82) of the inductor coil (26) is variable in dependence upon a magnitude of a flow of direct current through the DC bias coil (22). In one embodiment of the inductor, the first and the second magnetic core (20, 24) are each formed using a pair of U-shaped core segments (30, 32, 60, 62) located adjacent to one another. In this embodiment, the first and second magnetic core (20, 24) are located in an opposing relation to one another, with the DC bias coil (22) wound on inner legs (64, 72) of the first magnetic core (20) and the inductor coil (26) wound on inner legs (64, 72, 34, 44) of both the first and the second magnetic core (20, 24). A system employing the electrically controllable inductor is provided for dynamic correction of power factor and reduction of harmonics of a three-phase power line.

41 Claims, 6 Drawing Sheets

ELECTRICALLY CONTROLLABLE INDUCTOR

TECHNICAL FIELD

This invention relates to variable inductors, and more particularly, to variable inductors which are controlled electrically.

BACKGROUND ART

Variable inductors have been employed in a variety of applications where it is desired to be able to modify a characteristic of a frequency response of an electronic circuit. Specific applications which employ a variable inductor include timing circuits, tuning circuits, and calibration circuits. In a tuning circuit comprising an inductor and a capacitor, the use of a variable inductor may be preferred over a variable capacitor.

A common form of adjustment of a variable inductor involves a variation of an effective permeability of a magnetic path. The effective permeability of the magnetic path can be varied mechanically by modifying a location of a magnetic core within a wound helical coil. The effective permeability of the magnetic path can also be varied in an electrical manner. Here, an operating flux density is varied within the core material to modify the relative permeability therein.

An example of an electrically controllable inductor is shown in U.S. Pat. No. 4,620,144 to Bolduc. This variable inductor comprises a single magnetic core about which a primary coil and a control coil are wound. A direct current is supplied to the control coil for varying the inductance in the primary coil.

Disadvantages which result from electrically changing the permeability of the magnetic core of an inductor include current waveform distortion, limited capability in high power applications, and a limited range of variation of the inductance. Other disadvantages include the effect of increased heating of the core of an inductor in which the permeability is changed by increased saturation of the core. Further, the introduction of harmonics, or noise, on to the line is exacerbated by changing core permeability.

Inductors can be employed in the application of power factor correction and harmonic distortion reduction in the transmission of electrical power. In terms of an electric power transmission system comprising a power source, a load, and a line conductor connecting the load to the power source, the power factor of the load is defined as the ratio of the active power delivered to, or absorbed by, the load to the apparent power at the load. In response to a resulting expense incurred by loads having a low power factor, the rate structure employed by an electric utility company is such that the billing rate is increased by means of a penalty factor whenever the power factor of a customer drops below a threshold. For example, many utilities require that the power factor of industrial customers be an least 0.90 in order to benefit from the minimum billing rate. One method of correcting the power factor of a three-phase line entails adding balanced three-phase capacitors in parallel with the line.

The use of variable inductors in controlling power factor and harmonics was limited by inherent power and size limitations and the problems imposed by harmonics induced by such circuits themselves. Harmonics may be introduced to the line and existing harmonics may be aggravated by merely using capacitors to balance power factor in electrical lines. Although capacitors do not produce harmonics themselves, they can create circuits which resonate at frequencies at or near existing harmonic levels. Harmonic suppression is best achieved through use of appropriate harmonic filter inductors wired in parallel with the capacitor network. Such inductors are typically pre-tuned to specific harmonic frequencies.

SUMMARY OF THE INVENTION

A need therefore exists for a variable inductor having a high power capability, a wider ratio of variability than previously achieved, and an inherently lower tendency for inducing harmonics.

It is thus an object of the present invention to increase the power handling capability of an electrically controllable inductor.

Another object of the present invention is to increase the ratio of variability of an electrically controllable inductor.

A further object of the present invention is to reduce the distortion which results in an electrically controllable inductor.

A still further object is to provide an improved system for power factor correction and harmonic distortion reduction in the transmission of electrical power.

In carrying out the above objects, the present invention provides an electrically controllable inductor comprising a first magnetic core and a second magnetic core, wherein the second magnetic core is spaced apart from the first magnetic core. A first coil is wound on the first magnetic core, and a second coil is wound on both the first magnetic core and the second magnetic core. An inductance of the second coil is variable in dependence upon a flow of direct current through the first coil.

Further in carrying out the above objects, the present invention provides a system for correcting a power factor of a multi-phase line. A shunt network having at least one electrically controllable inductor and at least one capacitor is coupled to the multi-phase line. The at least one electrically controllable inductor includes a first magnetic core, a second magnetic core spaced apart from the first magnetic core, a first coil wound on the first magnetic core, and a second coil wound on both the first magnetic core and the second magnetic core. A harmonic distortion monitor is coupled to the power line for making at least one harmonic distortion measurement. A power factor monitor is coupled to the multi-phase line for making at least one power factor measurement. A processor responds to the distortion monitor by applying a direct current to the first coil of the at least one electrically controllable inductor in dependence upon the distortion measurement. The processor further suitably controls the capacitance of the at least one capacitor in dependence upon the at least one power factor measurement. The direct current acts to correct the power factor by varying an inductance of the at least one electrically controllable inductor. The at least one capacitor acts to correct the power factor as measured by the power factor monitor.

Still further in carrying out the above objects, the present invention provides a system for reducing harmonics in a power line. A shunt network having at least one electrically controllable inductor is coupled to the power line. The at least one electrically controllable inductor includes a first magnetic core, a second magnetic core spaced apart from the first magnetic core, a first coil wound on the first magnetic core, and a second coil wound on both the first magnetic core and the second magnetic core. A distortion meter is coupled to the power line for making at least one distortion measurement. A processor responds to the distortion monitor by applying a direct current to the first coil of the at least one electrically controllable inductor in dependence upon the at least one distortion measurement. The direct current acts to reduce the harmonic distortion by varying an inductance of the at least one electrically controllable inductor.

Yet still further, the present invention provides a system for reducing harmonics in a multi-phase power line having a plurality of phases. An inductor network having a plurality of nodes is formed by an interconnection of at least one electrically controllable inductor. Each of a plurality of capacitors is coupled to a corresponding node of the inductor network, and is directly coupled to a corresponding phase of the multi-phase line. A harmonic distortion monitor is coupled to the multi-phase line for making at least one harmonics distortion measurement. A processor applies a direct current to the at least one electrically controllable inductor in dependence upon the at least one harmonics distortion measurement. The direct current acts to reduce the harmonics distortion in the multi-phase line by varying an inductance of the at least one electrically controllable inductor.

These and other features, aspects, and advantages of the present invention will become better understood with regard to the following description, appended claims, and accompanying drawings.

BEST MODES FOR CARRYING OUT THE INVENTION

Figure 1:
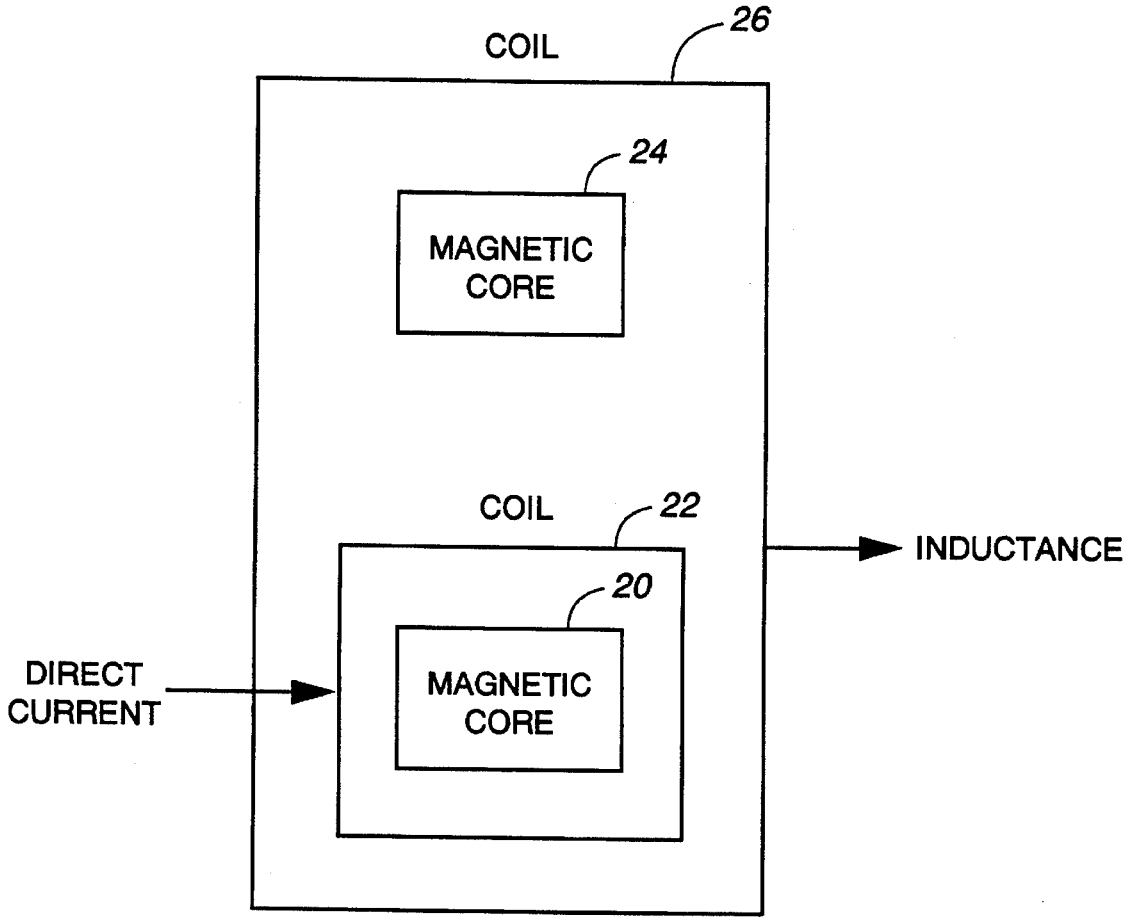
FIG. 1 is a block diagram of an embodiment of the present invention.

FIG. 1 shows a block diagram of an embodiment of an electrically controlled inductor of the present invention. The inductor comprises a first magnetic core 20 on which a first coil 22 is wound. The inductor further comprises a second magnetic core 24 spaced apart from the first magnetic core 20. A second coil 26 is wound on both the first magnetic core 20 and the second magnetic core 24. The resulting structure of the inductor allows an inductance of the second coil 26 to be varied dependent upon a flow of direct current through the first coil 22.

Figure 2:
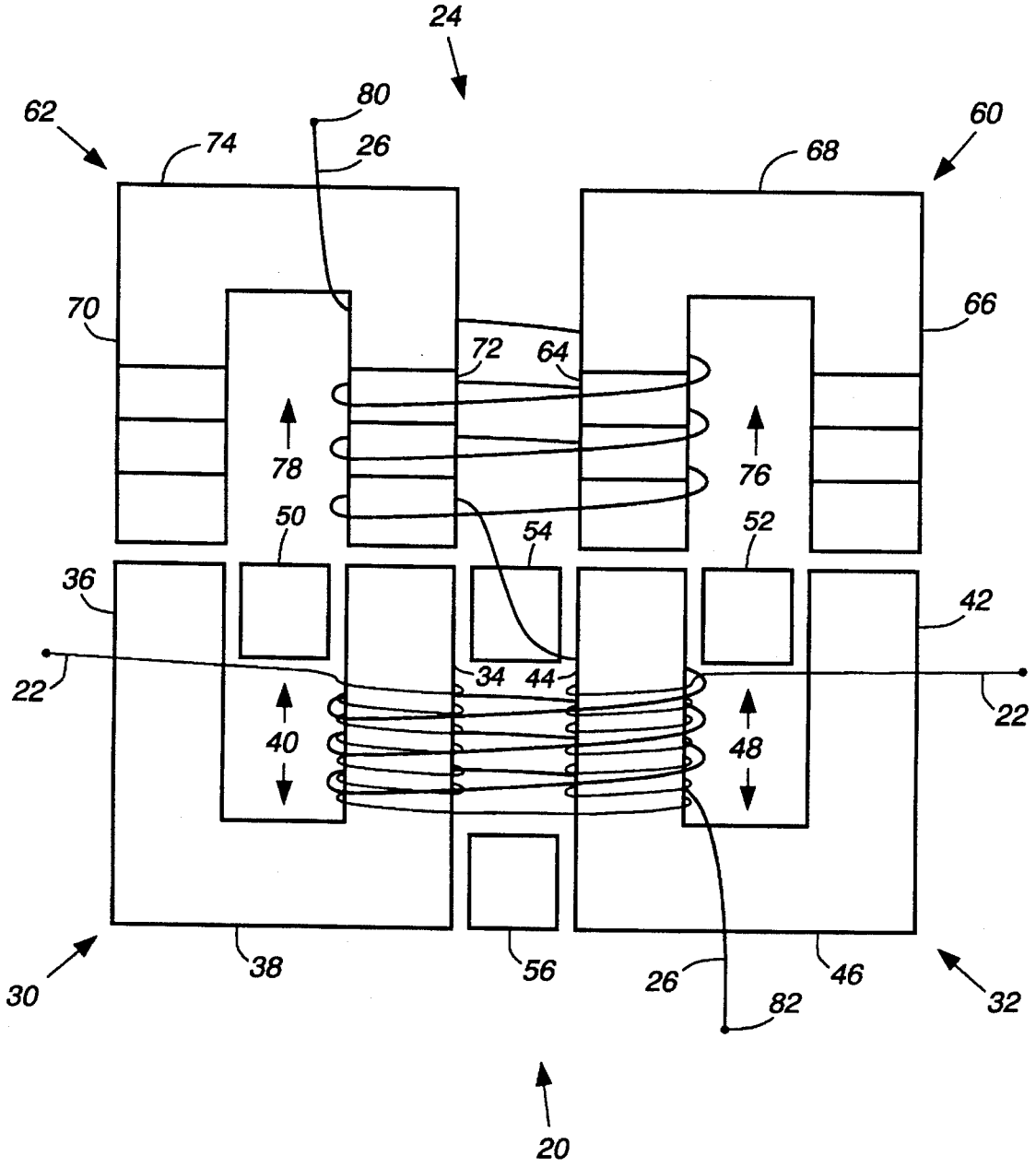
FIG. 2 is a plan view of an embodiment of the present invention.

Another embodiment of the electrically controlled inductor is illustrated in FIG. 2. The first magnetic core 20 is comprised of a first U-shaped core segment 30 and a second U-shaped core segment 32. The first U-shaped core segment 30 includes a right leg 34, a left leg 36, and a transverse leg 38. The first U-shaped core segment 30 defines an aperture 40 opposite the transverse leg 38 between the right leg 34 and the left leg 36. Similarly, the second U-shaped core segment 32 has a right leg 42, a left leg 44, and a transverse leg 46. An aperture 48 is defined in the second U-shaped core segment 32 opposite the transverse leg 46 between the right leg 42 and the left leg 44. the second U-shaped core segment 32 is located adjacent to and spaced from the first U-shaped core segment 30 such that the right leg 34 of the first U-shaped core segment 30 is located alongside the left leg 44 of the second U-shaped core segment 32. The first and second U-shaped core segments 30 and 32 are constructed of either stamped or cut and stacked steel pieces.

A first shunt 50 is located in the aperture 40 of the first U-shaped core segment 30, and a second shunt 52 is located in the aperture 48 of the second U-shaped core segment 32. The first and second shunts 50 and 52 are each placed at the upper limit of the first and second U-shaped core segments 30 and 32, respectively, so that each shunt is contained entirely within the legs of the U-shaped segment, and does not extend beyond the upper limit thereof. A third shunt 54 and a fourth shunt 56 are each situated between the right leg 34 of the first U-shaped core segment 30 and the left leg 44 of the second U-shaped core segment 32. The third shunt 54 is located at the upper limit between the first and the second U-shaped core segments 30 and 32, while the fourth shunt 56 is located at the lower limit between the first and the second U-shaped core segments 30 and 32. The resulting array of the first, second, third, and fourth shunts 50, 52, 54 and 56 are used to connect the respective core legs and U-shaped core segments. Each of the shunts are constructed using additional stacks of core steel. As a result, the shunts are not interleaved as to become part of the core structure, but are of core size and material placed closely adjacent to such core structure.

The second magnetic core 24 comprises a third U-shaped core segment 60 and a fourth U-shaped core segment 62. The third U-shaped core segment 60 has a left leg 64, a right leg 66, and a transverse leg 68. Similarly, the fourth U-shaped core segment 62 has a left leg 70, a right leg 72, and a transverse leg 74. The third U-shaped core segment 60 defines an aperture 76 opposite the transverse leg 68 between the left leg 64 and the right leg 66, while the fourth U-shaped core segment 62 defines an aperture 78 opposite the transverse leg 74 between the left leg 70 and the right leg 72. The third U-shaped core segment 60 is located adjacent to and spaced from the fourth U-shaped core segment 62 such that the left leg 64 of the third U-shaped core segment 60 is located alongside the right leg 72 of the fourth U-shaped core segment 62.

The left leg 64 and the right leg 66 of the third U-shaped core segment 60 and the left leg 70 and the right leg 72 of the fourth U-shaped core segment 62 are each constructed of stacked pieces of core steel aligned to form a distributed-gap type of core structure. This core structure aids in preventing the flow of eddy currents. The stacked pieces of core steel can be interleaved at the ends to make the magnetic path as continuous as possible in order to reduce flux leakage. The remainder of the third U-shaped core segment 60 and the fourth U-shaped core segment 62 can be constructed either of stamped or of cut and stacked steel pieces.

The first magnetic core 20 and the second magnetic core 24 are situated in an opposing relationship with one another. Namely, the left leg 70 of the fourth U-shaped core segment 62 is aligned with the left leg 36 of the first U-shaped core segment 30, the right leg 72 of the fourth U-shaped core segment 62 is aligned with the right leg 34 of the first U-shaped core segment 30, the left leg 64 of the third U-shaped core segment 60 is aligned with the left leg 44 of the second U-shaped core segment 32, and the right leg 66 of the third U-shaped core segment 60 is aligned with the right leg 42 of the second U-shaped core segment 32. Also, the aperture 78 of the fourth U-shaped core segment 62 is adjacent and opposing the aperture 40 of the first U-shaped core segment 30, and the aperture 76 of the third U-shaped core segment 60 is adjacent and opposing the aperture 48 of the second U-shaped core segment 32.

The first coil 22 is formed of a first conductor, such as a first continuous length of insulated copper wire, wound into a coil about a combination of the right leg 34 of the first U-shaped core segment 30 and the left leg 44 of the second U-shaped core segment 32. The first coil 22 contains and encircles legs 34 and 44 between transverse legs 38 and 46 and the first and second shunts 50 and 52. Moreover, the first coil 22 is situated below the third shunt 54 and above the fourth shunt 56.

The second coil 26 comprises a second conductor, such as a second continuous length of insulated copper wire, wound into a coil about both the second magnetic core 24 and the first magnetic core 20. More specifically, the second coil 26 is formed by winding the second conductor around the first coil 22 on the first magnetic core 20 between the transverse legs 38 and 46 and the first and second shunts 50 and 52. The remainder of the second conductor is wound on a combination of the left leg 64 of the third U-shaped core segment 60 and the right leg 72 of the fourth U-shaped core segment 62. The length of the portion of the second conductor wound around the first coil 22 is selected based upon the desired ratio of inductance variation. The length of the portion of the second conductor wound around the second magnetic core 24 is determined in relation to the inductance required by the inductor. The size or gauge of the second coil 26 is selected with consideration to the amperage that the inductor will be required to carry.

The turns of the second coil 26 are selected based upon a desired ratio of inductance change to an initial or starting level of inductance. In practice, the first coil 22 acts as a DC bias coil. Specifically, the first coil 22 is connected to a DC current source that is varied in order to control the variable inductance. Embodiments of the present invention are not limited to a dual-helical winding of the first coil 22, wherein a first helix is wound about the right leg 34 and a second helix is wound about the left leg 44, as illustrated in FIG. 2. As an alternative, a single-helical winding of the first coil 22, which contains and encircles legs 34 and 44, can be employed.

One with ordinary skill in the art will recognize that other core materials may be used to construct the first and second magnetic cores 20 and 24 of the present invention. The choice of core material and structure based upon the desired saturation limit of the core, the desired level of harmonic current suppression, as well as physical factors such as size and weight of the core.

A discussion of the use of embodiments of the present invention is now given. Terminal connections 80 and 82 of the coil 26 are connected within a circuit in a fashion normal for any inductor. Thus, the coil 26 is connected to the load or line as would be the case for any inductor application. Coil 22 is connected to a source of DC current. By introducing a DC current to coil 22, the effective turns of the winding of coil 26 is changed. Changing the effective turns of the coil 26 results in changing its inductance for constant core dimension and wire size parameters. Thus, by varying the DC current on coil 22 the inductance of coil 26 is variable, typically up to a factor of 10 to 1. The inductance in coil 26 is decreased for higher values of DC current. In order to provide for maximum variability or range in an inductance setting, the device must be designed to withstand the amperage and heat levels of the highest level of DC bias current anticipated. However, lower levels of variability and range do not introduce a significant design constraint.

Figure 3:
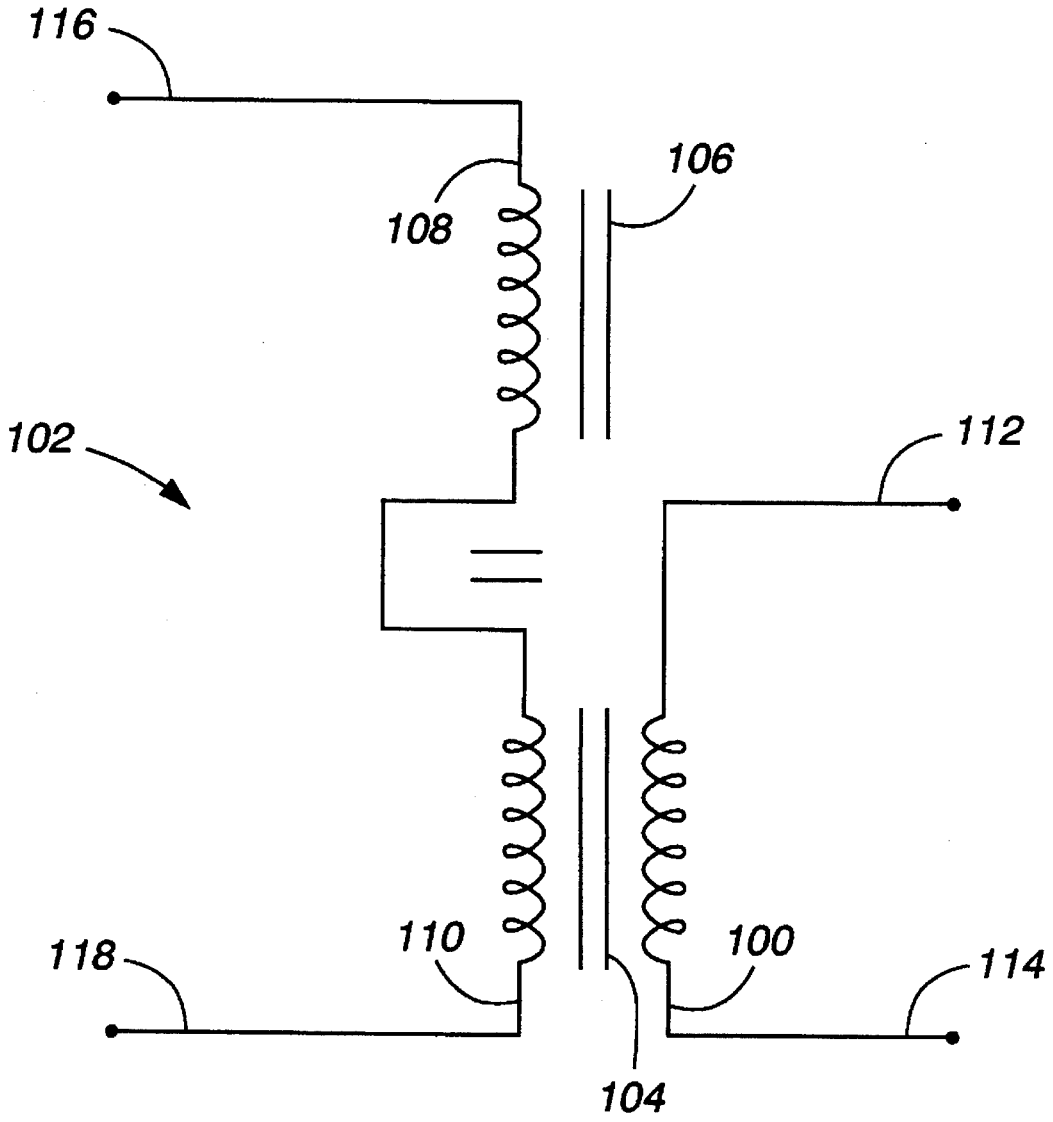
FIG. 3 is a schematic of an embodiment of the present invention.

A schematic embodiment of an electrically controlled inductor is shown in FIG. 3. This embodiment of the inductor comprises a first coil 100, a second coil 102, a first magnetic core 104, and a second magnetic core 106. The first coil 100 is wound on the first magnetic core 104. The second coil 102 comprises a first inductor 108 wound on the second magnetic core 106, and a second inductor 110 wound on the first magnetic core 104. As with the embodiment of FIG. 1, terminal connections 112 and 114 of the first coil 100 are connected to a DC current source for adjusting a resulting inductance seen at terminal connections 116 and 118 of the second coil 102.

It should be noted that the preferred construction set forth above provides relatively independent magnetic flux paths as between the upper core segments 60–62 and the lower core segments 30–32. In other words, the combined use of an air gap between these upper and lower core segments and the shunts 50–52 serve to link, yet isolate the magnetic flux paths created by the current flow through the coils 22 and 26. More importantly, the magnetic flux created by the current flow through the D.C. bias coil 22 is controlled in terms of its path and direction. While the path of the A.C. and D.C. magnetic flux is shared in rectangle defined by the shunts 54–56 and the adjacent legs 34 and 44 of the lower core segments, this flux path is isolated from the flux path through the upper core segments 60–62. Thus, it may be possible for the current flow through the D.C. bias coil 22 to partially saturate or partially unsaturate the flux path through core legs 34 and 44, but the flux path through the upper core segments 60–62 will not be affected. In this regard, in the preferred embodiment the shunts 50–52 provide high reluctance paths, while the shunts 54–56 provide low reluctance paths to facilitate and guide the flow of magnetic flux from the current introduced into the D.C. bias coil 22. It should also be noted that the use of a distributed air-gap is preferred because it reduces the heat generated by the electrically controllable inductor, but such a gap arrangement is not essential to the invention.

One of the other benefits of the present invention is that it provides an infinitely variable, but finite range of inductance. In other words, there is an inductance provided by the electrically controllable inductor even when the D.C. current component supplied to the D.C. bias coil 22 has saturated the lower core legs 34 and 44. This inductance is due to the turns of the coil 26 around the upper core segments 60–62. While it may be possible in some applications to obviate the need for the upper core segments 60–62, the turns of the coil 26 thereon, and even the shunts 50–52, there would be no starting inductance available with full bias on the D.C. bias coil 22. Accordingly, the use of two distinct and independent flux paths and a controlled D.C. flux path for one of these flux paths enables the inductance of the electrically controlled inductor to be varied in an unbroken continuum between two specifically defined inductance values.

Additional variations of the present invention that may be made include the use of an unregulated D.C. current component, a pulse-width modulated D.C. current component or other types of signals which contain D.C. current components. Similarly, it is not necessary for the windings of the first and second coils to be physically overlapped around the lower core segments 30–32 For example, D.C. bias coil 22 could be wound around the core legs 34 and 44 either above or below some portion of the windings for the coil 26 on these same core legs. In this regard, the D.C. bias coil 22 needs to be closely coupled to the magnetic core, and should be below the windings of the coil 26 if they are to be overlapped. Therefore, it should be understood that the present invention is susceptible to considerable variation. While the specific structure shown in FIG. 3 is particularly advantageous for a number of reasons, such as it generates very little harmonic current distortion, other suitable arrangements and constructions are quite possible without departing from the scope of the present invention. Nevertheless, it should be appreciated that some variations may be less beneficial than others. For example, certain changes in core construction may well provide an infinitely variable range of inductance between a nonzero lower inductance value and an upper inductance value, but distortions in the line current could be magnified as well.

Figure 4:
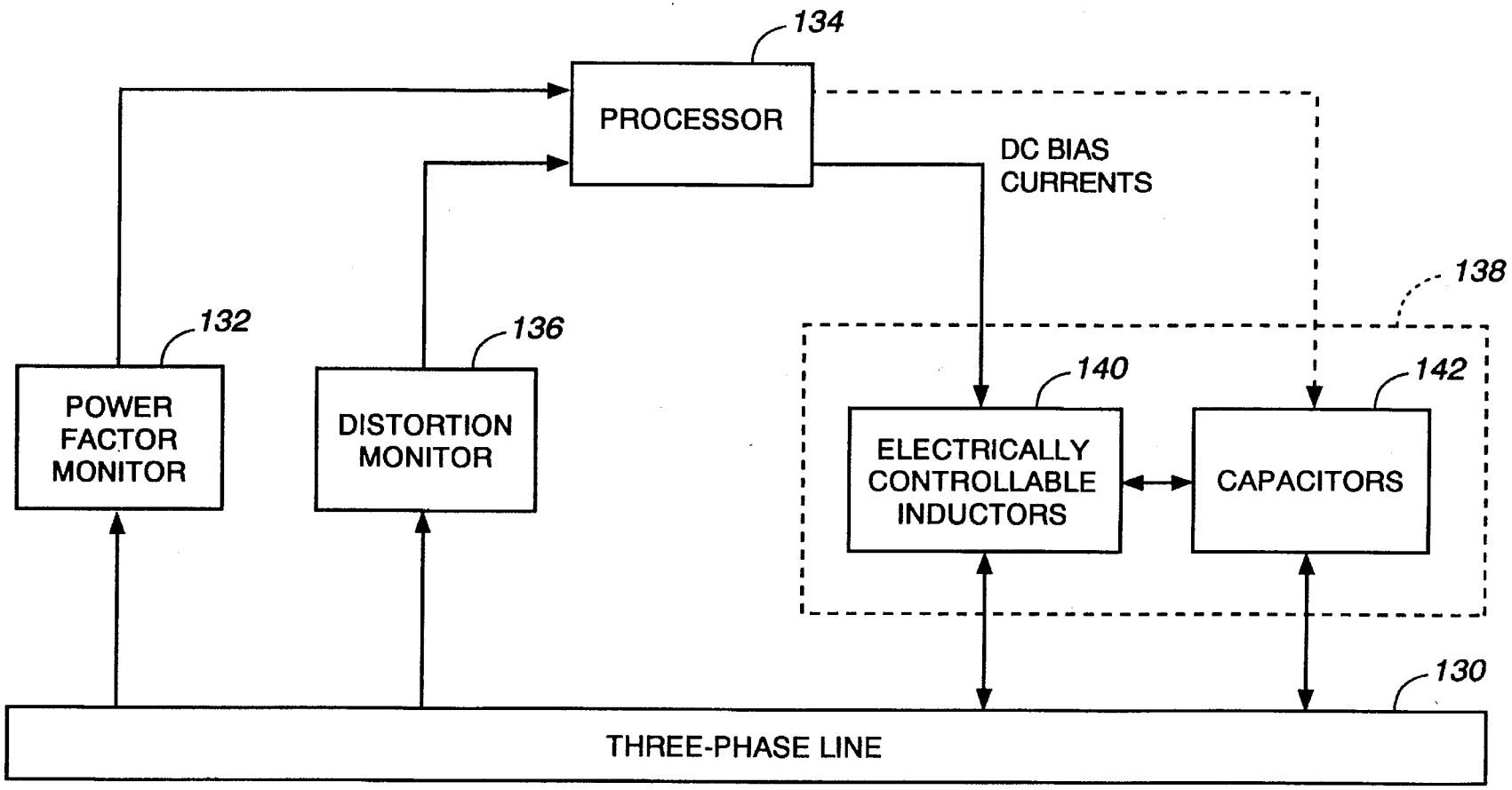
FIG. 4 is a block diagram of a system for providing dynamic power factor correction and harmonic distortion reduction; and FIGS. *5a–5d* show four versions of the shunt network.

FIG. 4 shows a block diagram of a system for providing dynamic power factor correction and harmonic distortion reduction for a three-phase line 130 using the electrically controlled inductor of the present invention. The power factor of each of the three phases of the three-phase line 130 is measured by a power factor monitor 132 and applied to a processor 134. Similarly, the harmonic distortion of each of the three phases of the three-phase line 130 is measured by a distortion monitor 136 and applied to the processor 134. A capacitor/inductor shunt network 138 is coupled to the three-phase line 130 for the purpose of applying reactive power to improve the power factor and the purpose of filtering to reduce harmonic distortion. The shunt network 138 comprises one or more electrically controllable inductors 140 and one or more capacitors or capacitor banks 142, wherein the electrically controllable inductors 140 and the capacitors 142 are electrically coupled within the shunt network 138.

The processor 134 provides means for supplying suitable values of DC bias current to apply to each of the electrically controllable inductors 140 in order to tune such inductors to the capacitor banks or networks needed to improve the power factor and reduce the harmonic distortion for each phase of the three-phase line 130. Given a selected number of the capacitors or capacitor banks 142 needed to control the power factor as detected by the monitor 132, the processor 134 suitably adjusts each of the variable capacitors or switches to an appropriate amount of capacitance for the correction required. The processor 134 comprises either an analog or digital computation device, such as commercially available microprocessor, programmed to provide suitable control of the electrically controlled inductors 140 and any variable capacitors.

Figure 5A:
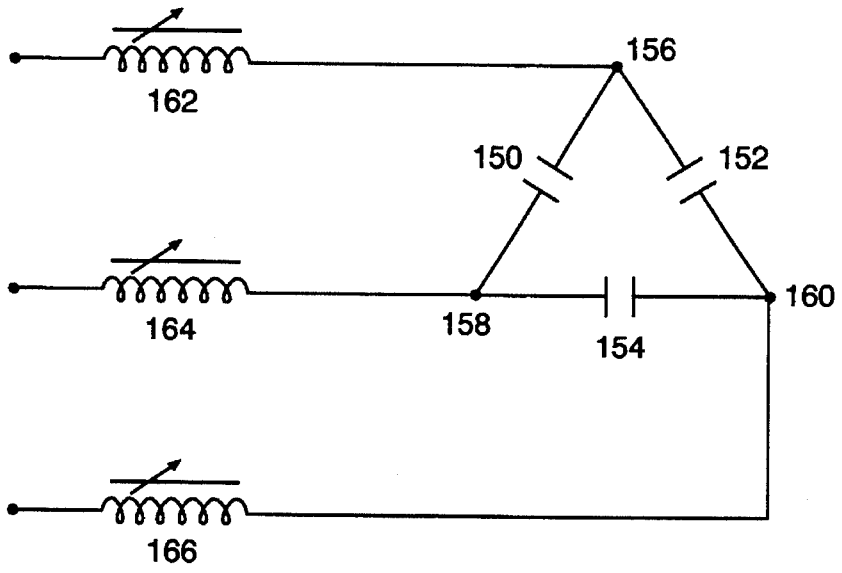

Specific versions of the shunt network 138 are shown schematically in FIGS. 5*a*–5*d*. Each of the illustrated networks comprise three capacitors or capacitor banks and three electrically controlled inductors. In the network of FIG. 5*a*, a first capacitor bank 150, a second capacitor bank 152, and a third capacitor bank 154 are electrically connected in a delta configuration. Three nodes result from the delta configuration: a first node 156, a second node 158, and a third node 160. A first inductor 162 is coupled to the first node 156, a second inductor 164 is coupled to the second node 158, and a third inductor 166 is coupled to the third node 160. Each of the first, second, and third inductor 162,164, and 166 is coupled to a respective one of the three phases of the line 130.

Figure 5B:
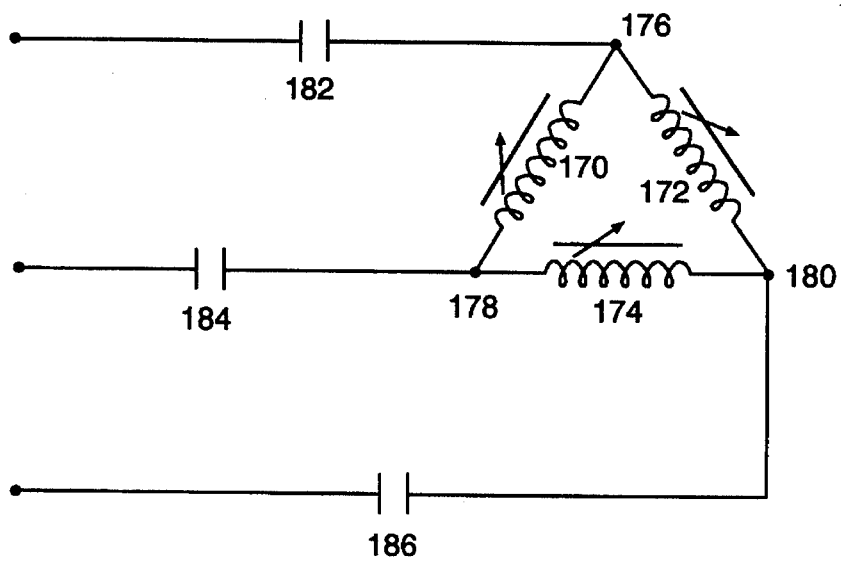

In the network of FIG. 5*b*, a first inductor 170, a second inductor 172, and a third inductor 174 are electrically connected in a delta configuration. A first node 176, a second node 178, and a third node 180 result from the delta configuration. A first capacitor bank 182 is coupled to the first node 176, a second capacitor bank 184 is coupled to the second node 178, and a third capacitor bank 186 is coupled to the third node 180. Each of the first, second, and third capacitor banks 182, 184, and 186 is coupled to a respective one of the three phases of the line 130.

Figure 5C:
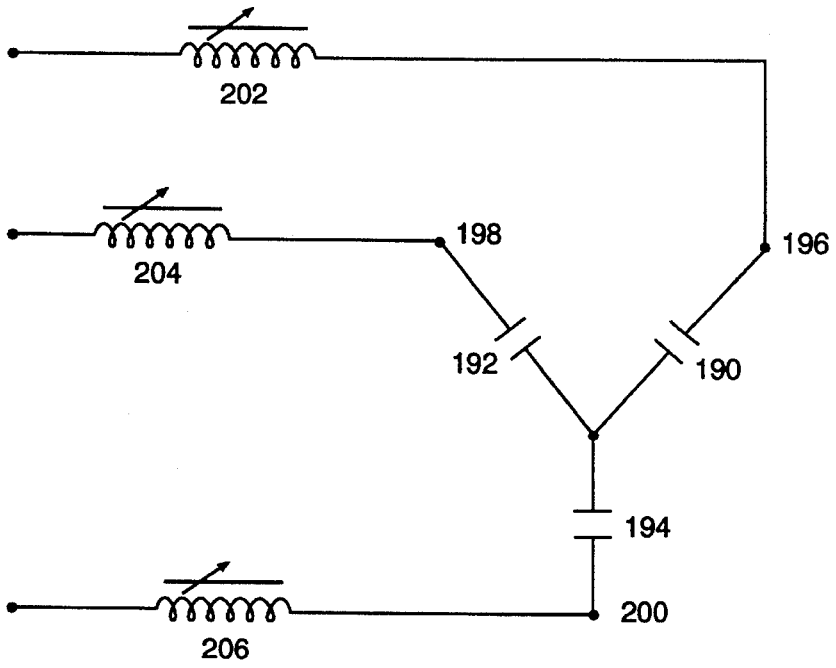

In the network of FIG. 5*c*, a first capacitor bank 190, a second capacitor bank 192, and a third capacitor bank 194 are electrically connected in a wye configuration. Three branch nodes result from the wye configuration: a first node 196, a second node 198, and a third node 200. A first inductor 202 is coupled to the first node 196, a second inductor 204 is coupled to the second node 198, and a third inductor 206 is coupled to the third node 200. Each of the first, second, and third inductor 202, 204, 206 is coupled to a respective one of the three phases of the line 130.

Figure 5D:
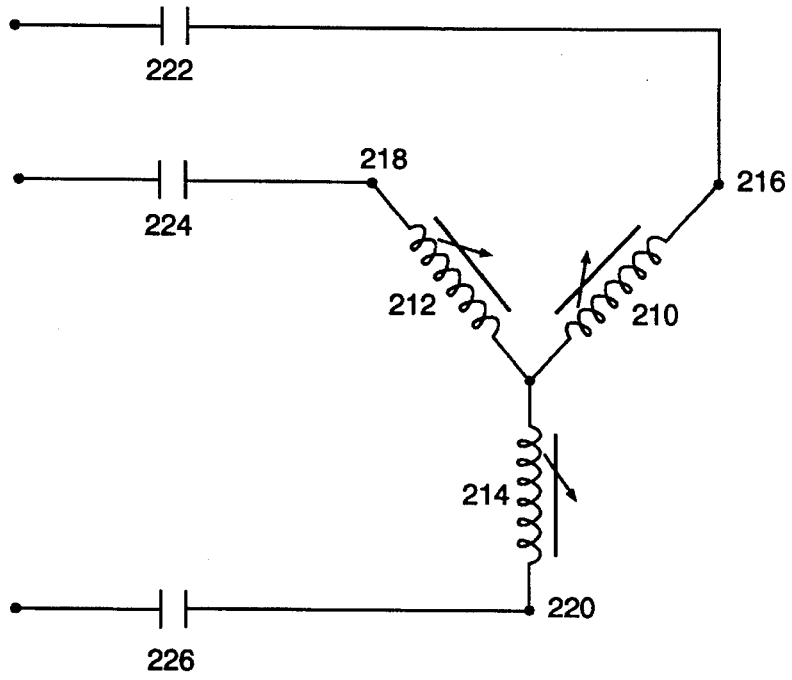

In the network of FIG. 5*d*, a first inductor 210, a second inductor 212, and a third inductor 214 are electrically connected in a wye configuration. Three branch nodes result from the wye configuration: a first node 216, a second node 218, and a third node 220. A first capacitor bank 222 is coupled to the first node 216, a second capacitor bank 224 is coupled to the second node 218, and a third capacitor bank 226 is coupled to the third node 220. Each of the first, second, and third capacitor banks 222, 224, 226 is coupled to a respective one of the three phases of the line 130.

One with ordinary skill in the art will recognize that embodiments of the system for power factor correction and harmonic distortion reduction can be formulated for any single-phase or multi-phase line, and are not limited to the embodiment for the three-phase line of FIG. 4.

Whereas other previously designed methods of varying an inductance depend upon changing the permeability of the inductor core, embodiments of the present invention depend upon a new principle, namely, varying the effective turns of the coil 26 by means of counteracting the windings through use of a DC bias coil 22. This new principle offers the advantages of higher variability, lower overall size, lower cost, and the ability to change the effective turns of the inductor winding without relying on effecting the permeability of the entire, or even a substantial part of, the magnetic core. This latter advantage is particularly significant because core permeability changes can be abrupt, noisy, sensitive to exogenous influences, and non-linear. By avoiding problems inherent in relying upon changes in permeability of the entire core, embodiments of the present invention are more controllable and more flexible.

While it appears as though the above-mentioned theory describes the operation of embodiments of the present invention, the applicants do not wish to be bound thereto.

Another advantage of the electrically controllable inductor results from the precise control of inductance which it makes possible. The shunt networks of FIGS. 5*b* and 5*d*, wherein the capacitors are directly coupled to the power line, are not customarily employed in low voltage systems using prior inductors. In order to avoid overheating of the capacitors due to harmonic distortion, the capacitors were not directly coupled to the power line in prior practice. However, the exacting control afforded by the electrically controllable inductor of the present invention allows the capacitors to be directly coupled to the power line without as much concern for overheating. Moreover, in high voltage applications where it is customary to connect capacitors directly to the line, to reduce the BIL requirement and thus the cost of the inductors, utilization of a controllable inductor may enhance capacitor life by shunting levels of harmonics so as to not overload the capacitor network.

A further advantage of the electrically controlled inductor is that it produces less current waveform distortion than inductors which change the permeability of the entire magnetic core. Hence, the electrically-controlled inductor of the present invention exhibits an inherently lower tendency for inducing additional harmonics. A still further advantage of the electrically controlled inductor results from the reduced generation of line noise compared to previous inductors.

Further advantages are evident by the capability of varying the inductance by at least a factor of ten in response to a low voltage power source, which can be either infinitely varied or stepped. Moreover, the inductor is simultaneously capable of handling reactive power values of 100 kVAR and up.

It should be noted that the present invention is embodied in structures which on average are smaller than their non-variable counterparts. Further, the present invention may be used in a wide variety of different constructions encompassing many alternatives, modifications, and variations which are apparent to those with ordinary skill in the art. Accordingly, the present invention is intended to embrace all such alternatives, modifications, and variations as fall within the spirit and broad scope of the appended claims.

What is claimed is:

1. An electrically controlled inductor comprising:

a first magnetic core;

a second magnetic core proximate to the first magnetic core;

a first coil wound on the first magnetic core; and a second coil wound on both the first magnetic core and the second magnetic core so as to share a winding path with the first coil and form an independent winding path about the second core;

wherein an inductance of the second coil is varied in dependence upon a flow of direct current through the first coil and the inductance is continuously variable over a range of inductances.

2. The electrically controlled inductor of claim 1 in the range of inductances is 10 to 1.

3. The electrically controlled inductor of claim 1 wherein the second coil is wound around the first coil on the first magnetic core.

4. An electrically controlled inductor comprising:

a first magnetic core;

a second magnetic core proximate to the first magnetic core;

a first coil wound on the first magnetic core; and a second coil wound on both the first magnetic core and the second magnetic core;

wherein an inductance of the second coil is varied in dependence upon a flow of direct current through the first coil;

a first U-shaped core segment having a right leg, a left leg, and a transverse leg, the first U-shaped core segment defining an aperture opposite the transverse leg between the right leg and the left leg; and a second U-shaped core segment having a right leg, a left leg, and a transverse leg, the second U-shaped core segment defining an aperture opposite the transverse leg between the right leg and the left leg;

wherein the second U-shaped core segment such that the right leg of the first U-shaped core segment is located alongside the left leg of the second U-shaped core segment.

5. The electrically controlled inductor of claim 4 further comprising:

a first shunt located in the aperture of the first U-shaped core segment; and a second shunt located in the aperture of the second U-shaped core segment.

6. The electrically controlled inductor of claim 4 further comprising:

a third shunt located between the right leg of the first U-shaped core segment and the left leg of the second U-shaped core segment; and a fourth shunt located between the right leg of the first U-shaped core segment and the left leg of the second U-shaped core segment.

7. The electrically controlled inductor of claim 4 wherein the first coil is wound on the right leg of the first U-shaped core segment and the left leg of the second U-shaped core segment.

8. The electrically controlled inductor of claim 4 wherein the second magnetic core comprises:

a third U-shaped core segment having a right leg, a left leg, and a transverse leg, the third U-shaped core segment defining an aperture opposite the transverse leg between the right leg and the left leg; and a fourth U-shaped core segment having a right leg, a left leg, and a transverse leg, the fourth U-shaped core segment defining an aperture opposite the transverse leg between the right leg and the left leg;

wherein the third U-shaped core segment is adjacent to the fourth U-shaped core segment such that the right leg of the third U-shaped core segment is located alongside the left leg of the fourth U-shaped core segment.

9. The electrically controlled inductor of claim 8 wherein the first magnetic core and the second magnetic core are located in an opposing relation such that the left leg of the fourth U-shaped core segment is aligned with the left leg of the first U-shaped core segment, the right leg of the fourth U-shaped core segment is aligned with the right leg of the first U-shaped core segment, the left leg of the third U-shaped core segment is aligned with the left leg of the second U-shaped core segment, and the right leg of the third U-shaped core segment is aligned with the right leg of the second U-shaped core segment.

10. The electrically controlled inductor of claim 8 wherein the second coil is wound on the right leg of the third U-shaped core segment and the left leg of the fourth U-shaped core segment.

11. The electrically controlled inductor of claim 10 wherein the second coil is further wound on the combination of the right leg of the first U-shaped core segment and the left leg of the second U-shaped core segment.

12. The electrically controlled inductor of claim 8 wherein the right leg and left leg of the third U-shaped core segment and the right leg and left leg of the fourth U-shaped core segment each has a distributed-gap core structure.

13. The electrically controlled inductor of claim 12 wherein the distributed-gap core structure comprises a stacking of a plurality of pieces of steel.

14. A system for correcting a power factor of a multi-phase line, the system comprising:

a shunt network coupled to the multi-phase line, the shunt network having a least one electrically controllable inductor and at least one capacitor, wherein the at least one electrically controllable inductor includes a first magnetic core, a second magnetic core proximate to the first magnetic core, a first coil wound on the first magnetic core, and a second coil wound on both the first magnetic core and the second magnetic core;

a distortion monitor, coupled to the power line, for making at least one distortion measurement;

a power factor monitor, coupled to the multi-phase line, for making at least one power factor measurement; and a processor, responsive to the distortion monitor and the power factor monitor, for applying a direct current to the first coil of the at least one electrically controllable inductor in dependence upon the at least one distortion measurement and for suitably controlling the capacitance of the at least one capacitor in dependence upon the at least one power factor measured;

wherein the direct current acts to reduce harmonics in the power line by varying an inductance of at least one electrically controllable inductor, and the at least one capacitor acts to correct the power factor as measured by the power factor monitor.

15. The system of claim 14 wherein the multi-phase line is a three-phase line.

16. A system for reducing harmonics in a power line, the system comprising:

a shunt network coupled to the power line, the shunt network having at least one electrically controllable inductor, wherein the at least one electrically controllable inductor includes a first magnetic core, a second magnetic core proximate to the first magnetic core, a first coil wound on the first magnetic core, and a second coil wound on both the first magnetic core and the second magnetic core;

a distortion monitor, coupled to the power line, for making at least one distortion measurement; and a processor, responsive to the distortion monitor, for applying a direct current to the first coil of the at least one electrically controllable inductor in dependence upon the at least one distortion measurement;

wherein the direct current acts to reduce the harmonics in the power line by varying an inductance of the at least one electrically controllable inductor.

17. The system of claim 16 wherein the power line is a single-phase line.

18. The system of claim 16 wherein the power line is a multi-phase line.

19. The system of claim 16 wherein the shunt network further includes at least one capacitor.

20. A system for reducing harmonics in a multi-phase power line having a plurality of phases, the system comprising:

an inductor network having a plurality of nodes, the network comprising an interconnection of at least one electrically controllable inductor;

a plurality of capacitors, each of the capacitors coupled to a corresponding node of the inductor network and directly coupled to a corresponding phase of the multi-phase line;

a distortion monitor, coupled to the multi-phase line, for making at least one distortion measurement;

a processor, responsive to the distortion monitor, for applying a direct current to the at least one electrically controllable inductor in dependence upon the at least one distortion measurement;

wherein the direct current acts to reduce the harmonics in the multi-phase line by varying an inductance of the at least one electrically controllable inductor.

21. The system of claim 20 wherein the at least one electrically controllable inductor includes a first magnetic core, a second magnetic core proximate to the first magnetic core, a first coil wound on the first magnetic core, and a second coil wound on both the first magnetic core and the second magnetic core.

22. The system of claim 21 wherein the processor applies the direct current to the first coil of the at least one electrically controllable inductor.

23. The system of claim 20 wherein the inductor network is a wye network.

24. The system of claim 20 wherein the inductor network is a delta network.

25. An electrically controllable inductor assembly comprising:

a first magnetic core including one or more first core components;

a second magnetic core including one or more second core components proximate to the first magnetic core;

a first coil wound on the first magnetic core; and a second coil wound on both the first and the second magnetic cores; and a low voltage power source connected to the first coil, the low voltage power source having a voltage which may be readily controlled with minimum equipment and complexity, the voltage being variable in either a continuous or step-wise manner;

wherein the inductance of the second coil may be varied by a factor of at least ten times that of a starting inductance in dependence upon a flow of direct current through the first coil so that the coils and the cores interact to produce a variable inductor which has:

diminished size in relation to variable inductors of comparable capacity, minimal harmonic distortion in relation to conventional variable inductors, reduced propensity to generate heat in relation to variable inductors of comparable capacity, the inductor being susceptible of assembly according to any size or scale with minimal harmonic distortion being induced by the inductor;

the assembly producing permeability changes in a minimal portion of any of its core components.

26. The electrically controllable inductor assembly of claim 25, further comprising a plurality of inductors which are electrically connected in a network to enable a multi-phase assembly to be constructed.

27. The assembly of claim 26 wherein the inductor network is a wye network.

28. The assembly of claim 26 wherein the inductor network is a delta network.

29. The assembly of claim 26, disposed in a system for reducing harmonics in a multi-phase power line having a plurality of phases, the system comprising:

an inductor network having a plurality of nodes, the network comprising an interconnection of at least one electrically controllable inductor;

a plurality of capacitors, each of the capacitors coupled to a corresponding node of the inductor network and directly coupled to a corresponding phase of the multi-phase line;

a distortion monitor, coupled to the multi-phase line, for making at least one distortion measurement; and a processor, responsive to the distortion monitor, for applying a direct current to the at least one electrically controllable inductor in dependence upon the at least one distortion measurement;

wherein the direct current acts to reduce the harmonics in the multi-phase line by varying an inductance of the at least one electrically controllable inductor.

30. The system of claim 29 wherein the at least one electrically controllable inductor includes a first magnetic core, a second magnetic core proximate to the first magnetic core, a first coil wound on the first magnetic core, and a second coil wound on both the first magnetic core and the second magnetic core.

31. The system of claim 30 wherein the processor applies the direct current to the first coil of the at least one electrically controllable inductor.

32. The system of claim 29 wherein the inductor network is a wye network.

33. The system of claim 29 wherein the inductor network is a delta network.

34. A method of varying the inductance of an inductor having a first coil wound on a magnetic core structure, comprising the steps of:

providing a second coil which is wound on said magnetic core structure so as to share a common flux path with only a portion of the windings for said first coil; and introducing a direct electrical current component to said second winding to vary the inductance in said inductor relative to the characteristic of said direct electrical current component through said second coil.

35. The method according to claim 34, wherein said second coil is wound only around said common portion of said magnetic core structure, while said first coil is wound around both said common portion of said magnetic core structure and another portion of said magnetic core structure which is isolated from the magnetic flux created by the current flow through said second coil.

36. The method according to claim 34, further including the step of adjusting the magnitude of said direct electrical current component.

37. The method according to claim 36, wherein the magnitude of said direct electrical current component is increased to decrease the effective number of turns in said first coil and the magnitude of said direct current component is decreased to increase the effective number of turns in said first coil.

38. The method according to claim 36, wherein adjustments in the magnitude of said direct current component are infinitely variable.

39. An inductor having an electrically controllable inductance which is infinitely variable between a first non-zero inductance value and a second non-zero inductance value, comprising:

first and second magnetic core segments constructed and arranged to provide independent magnetic flux paths;

a first coil wound around both said first and second magnetic core; and a second coil wound only around said second magnetic core segment, such that the said first and second coils share a common magnetic flux path along said second segment of said magnetic core.

40. The inductor according to claim 39, wherein said second coil is coupled to a variable source of a direct electrical current component, and said first coil is coupled to a source of alternating current.

41. An inductor having an electrically controllable inductance which is infinitely variable between two inductance values, comprising:

a plurality of magnetic core segments constructed and arranged in coordination with a plurality of air gaps to provide a predetermined inductance in its own closed magnetic flux path; and first and second coils wound across common segments of said magnetic, such that said first and second coils share said closed magnetic flux path.

* * * * *